US012680388B2

(12) United States Patent
Dobernig et al.

(10) Patent No.: US 12,680,388 B2
(45) Date of Patent: Jul. 14, 2026

(54) HANDHELD AUGERS OPERABLE IN A NORMAL MODE AND A BREAKER MODE

(71) Applicant: Milwaukee Electric Tool Corporation, Brookfield, WI (US)

(72) Inventors: Nicholas Dobernig, Brookfield, WI (US); Vishvajeet M. Ghorpade, Milwaukee, WI (US); Beth E. Cholst, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 18/322,032

(22) Filed: May 23, 2023

(65) Prior Publication Data

US 2023/0392445 A1 Dec. 7, 2023

Related U.S. Application Data

(60) Provisional application No. 63/349,240, filed on Jun. 6, 2022.

(51) Int. Cl.
*E21B 6/02* (2006.01)
*E21B 4/04* (2006.01)
(Continued)

(52) U.S. Cl.
CPC ..... *E21B 6/02* (2013.01); *E21B 4/04* (2013.01); *E21B 7/003* (2013.01); *E21B 7/027* (2013.01);
(Continued)

(58) Field of Classification Search
CPC . E21B 7/027; E21B 7/005; E21B 3/02; E21B 7/028; E21B 11/005
See application file for complete search history.

(56) References Cited

U.S. PATENT DOCUMENTS 3,407,888 A * 10/1968 Graipin ..... E21B 7/001 175/173
5,358,062 A * 10/1994 Uhl ..... E21B 3/035 188/77 R
(Continued)

FOREIGN PATENT DOCUMENTS

AU 2018206792 A1 2/2019
AU 2020386104 A1 5/2022
(Continued)

OTHER PUBLICATIONS

European Search Report Corresponding with Application No. EP23 17 6001 on Aug. 11, 2023 (1 page).

*Primary Examiner* — Robert E Fuller
(74) *Attorney, Agent, or Firm* — Dority & Manning, P.A.

(57) ABSTRACT

A hand operated auger may include a powerhead, a handle frame, and a drill bit, the drill bit extending along and rotatable about a longitudinal axis. The drill bit may be selectively operable in a normal mode and a breaker mode. The auger may further include an extension shaft disposed between the powerhead and the drill bit, wherein the drill bit is movable along the longitudinal axis relative to the extension shaft. The auger may further include a fluid reservoir and a fluid line. The auger may further include a gyroscope. The auger may further include a roller. The auger may further includes a depth gauge. An auger assembly may include an auger and a removable fixture.

18 Claims, 7 Drawing Sheets

(51) Int. Cl.

| | |
|---|---|
| ***E21B 7/00*** | (2006.01) |
| ***E21B 7/02*** | (2006.01) |
| ***E21B 10/44*** | (2006.01) |
| ***E21B 11/00*** | (2006.01) |

(52) U.S. Cl.
CPC ..... *E21B 10/44* (2013.01); *E21B 11/005* (2013.01); *E21B 7/028* (2013.01)

(56) References Cited

U.S. PATENT DOCUMENTS

| | | | | |
|---|---|---|---|---|
| 6,283,229 | B1 * | 9/2001 | Wentworth | E21B 7/30 405/184 |
| 2011/0024196 | A1 * | 2/2011 | Allouche | E21B 7/046 175/73 |
| 2014/0174824 | A1 | 6/2014 | Schamberger et al. | |
| 2014/0216773 | A1 | 8/2014 | Steurer | |
| 2019/0195019 | A1 | 6/2019 | Wang | |
| 2020/0095830 | A1 | 3/2020 | Wong et al. | |

FOREIGN PATENT DOCUMENTS

| | | | | | |
|---|---|---|---|---|---|
| CN | 207484549 | U | | 6/2018 | |
| DE | 3416513 | A | * | 11/1985 | E21B 4/16 |
| EP | 3833842 | A1 | | 6/2021 | |
| KR | 20200020550 | A | * | 2/2020 | E21B 7/022 |

* cited by examiner

HANDHELD AUGERS OPERABLE IN A NORMAL MODE AND A BREAKER MODE

CROSS-REFERENCE TO RELATED APPLICATIONS

The present application claims priority to U.S. Provisional Patent Application No. 63/349,240 filed on Jun. 6, 2022, the disclosure of which is incorporated by reference herein in its entirety.

FIELD

The present disclosure relates generally to outdoor tools such as augers, and in particular to hand-operated augers having features which facilitate improved digging capabilities.

BACKGROUND

Hand-operated digging apparatus, such as ground augers, are widely used to penetrate the ground and dig holes in the earth. A typical electric powered auger includes a powerhead and a rotatable drill bit with a helical auger blade coaxially mounted around the drill bit. An electric powered motor in the powerhead drives the drill bit and rotates the helical auger blade, which causes the drill bit to penetrate the soil.

Generally, hand-operated augers are designed to be used with a broad range of soil or sand types having diverse physical properties and compositions. Accordingly, hand-operated augers having features which facilitate improved digging capabilities, such as in a variety of environments, would be advantageous.

BRIEF DESCRIPTION

Aspects and advantages of the invention in accordance with the present disclosure will be set forth in part in the following description, or may be obvious from the description, or may be learned through practice of the technology.

In accordance with one embodiment, an auger may include a powerhead, a handle frame, and a drill bit, the drill bit extending along and rotatable about a longitudinal axis.

In some embodiments, the drill bit may be selectively operable in a normal mode and a breaker mode.

In some embodiments, the auger may include an extension shaft disposed between the powerhead and the drill bit, wherein the drill bit is movable along the longitudinal axis relative to the extension shaft.

In some embodiments, the auger may include a fluid reservoir and a fluid line.

In some embodiments, the auger may include a gyroscope.

In some embodiments, the auger may include a roller.

In some embodiments, the auger may include a depth gauge.

In some embodiments, an auger assembly includes an auger and a removable fixture.

These and other features, aspects and advantages of the present invention will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present invention, including the best mode of making and using the present systems and methods, directed to one of ordinary skill in the art, is set forth in the specification, which makes reference to the appended figures, in which.

DETAILED DESCRIPTION

Figure 1:
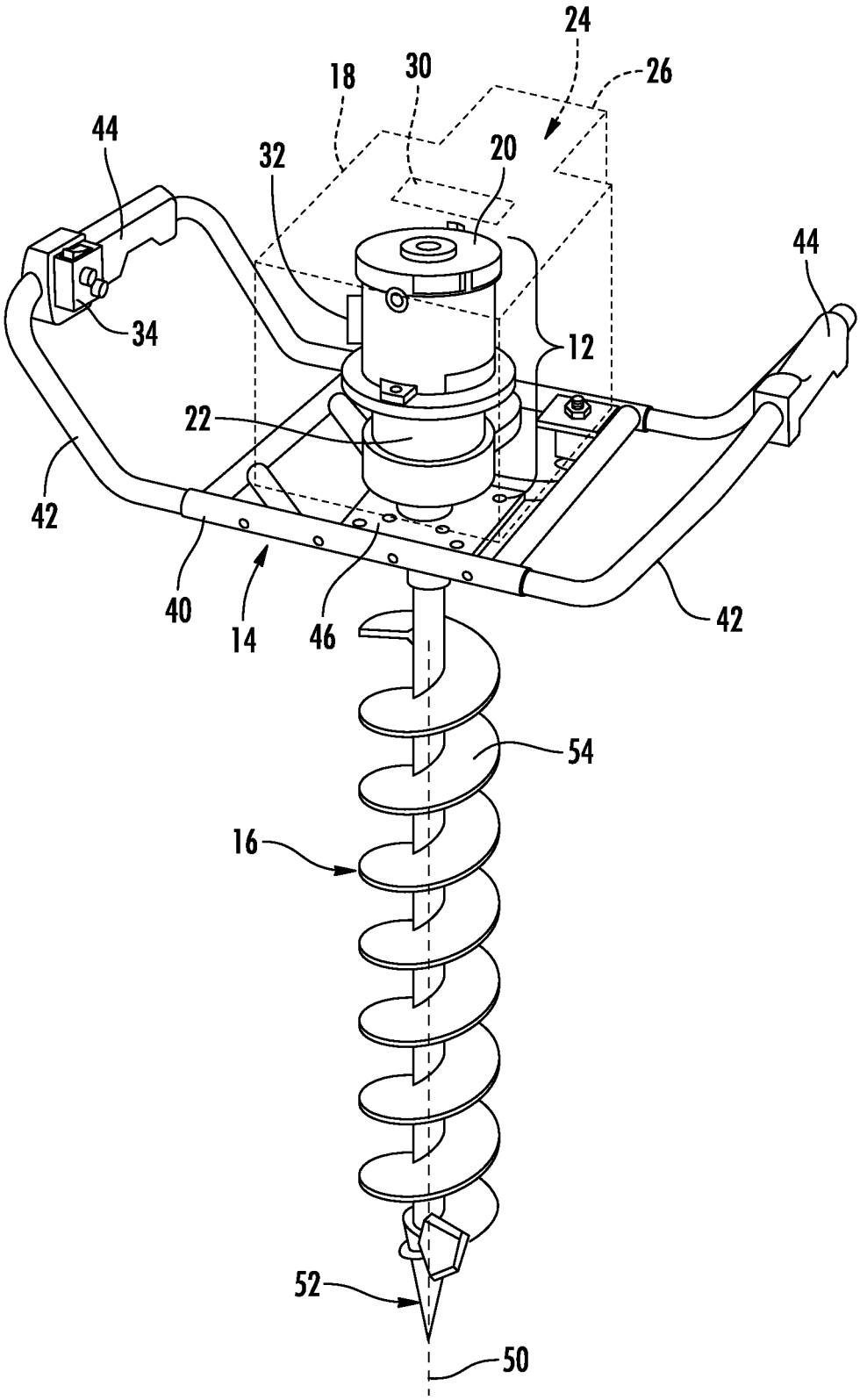
FIG. 1 provides a perspective view of an auger in accordance with embodiments of the present disclosure.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

In general, the present disclosure is directed to improved hand-operated augers. Referring now to FIG. 1, one embodiment of a hand-operated auger 10 is provided. Auger 10 may include a powerhead 12, a handle frame 14 and a drill bit 16. Powerhead 12 may be disposed within a housing 18. The auger 10 may be a hand-operated auger that can be used for a variety of applications, and in particular, for drilling small-dimension deep holes into substrate. The substrate may be soil, sand, wall, wood, concrete, ice, etc. For instance, the drilled hole can be used for planting a tree, piling a post, or constructing a building foundation. In the case of ice drilling, the drilled hole can be used for ice fishing and under-ice exploration. An operator usually places the auger 10 vertically above the desired position of the hole to be drilled so that the drill bit 16 can drill vertically downward into the substrate.

The powerhead 12 may include a motor 20 and a gearbox 22. One or more battery interfaces 24 may be provided, such as on the housing 18, for receiving one or more batteries 26. The battery may be a 36V lithium battery pack or two 18V lithium battery packs. Alternatively, however, other suitable batteries may be utilized, or the auger 10 may be gas-powered or electrically powered via a wired connection. The batter(ies) or other suitable power source may be in communication with the motor 20 to selectively operate the motor 20, and thus the powerhead 12 and auger 10 generally.

Auger 10 may further include a user interface 30 for an operator to control and/or configure the auger 10. The user interface 30 may comprise one or more of a trigger, indicator, display, mechanical button, membrane button, and/or touch screen. User interface 30 may be provided on the housing 18 and/or handle grips 44, and/or in other suitable locations. A PCB or other suitable control apparatus 32 may be provided, such as within the housing 18, and may provide an electrical interface for electrical communication with one or more sensors disposed outside the housing 18. The user interface 30 and control apparatus 32 may be in communication with each other and/or the power source, such the battery, and the motor 20 to control selective operation of the motor 20, and thus the powerhead 12 and auger 10 generally, in accordance with user instructions.

The handle frame 14 of the auger 10 may include, for example, a bottom frame 40 and two side frames 42. One or more handle grips 44 may be mounted to or from the handle frame 14. In certain embodiments, the bottom frame 40 defines a sunk area, such that the powerhead 12 is at least partially surrounded by the bottom frame 40 for better protection. The powerhead 12 may be attached to and detached from the bottom frame 40 through a mounting plate 46 for easy transportation. In certain embodiments such attachment and detachment are achieved without using of tools. In some embodiments, a soft protective material may be wrapped around the bottom frame 40 and/or the side frames 42 to reduce the transmission of vibration from the auger 10 to the operator when operating the auger 10.

As discussed, in some embodiments, two side frames 42 are mounted to or otherwise fixed to the bottom frame 40. In some embodiments, the two side frames 42 are symmetrical to each other and may each have a U-shape. The two side frames 42 may bend upwardly from the bottom frame 40. In such a configuration, the handle grips 44 can have a higher vertical position than the bottom frame 40. For example, the bottom frame 40 can be at a level around an operator's waist or thigh when the operator grips the two handle grips 44 and operate the auger 10.

In certain embodiments, a control trigger or button 34, which may be a component of the user interface 30, is provided on at least one of the handle grips 44, to be manually operable by the operator. When the control trigger or button 34 is in the "ON" position, the motor 20 of the auger 10 may be operated. When the control trigger or button 34 is in the "OFF" position, the motor 20 of the auger 10 is prevented from being operated.

The drill bit 16 may extend along a longitudinal axis 50 from the powerhead 12 to a distal end 52, and may include a helical auger blade 54. Operation of the powerhead 12 may cause rotation of the drill bit 16 about the longitudinal axis Augers 10 in accordance with the present disclosure may include one or more additional features which facilitate improved operation as discussed herein.

Figure 2:
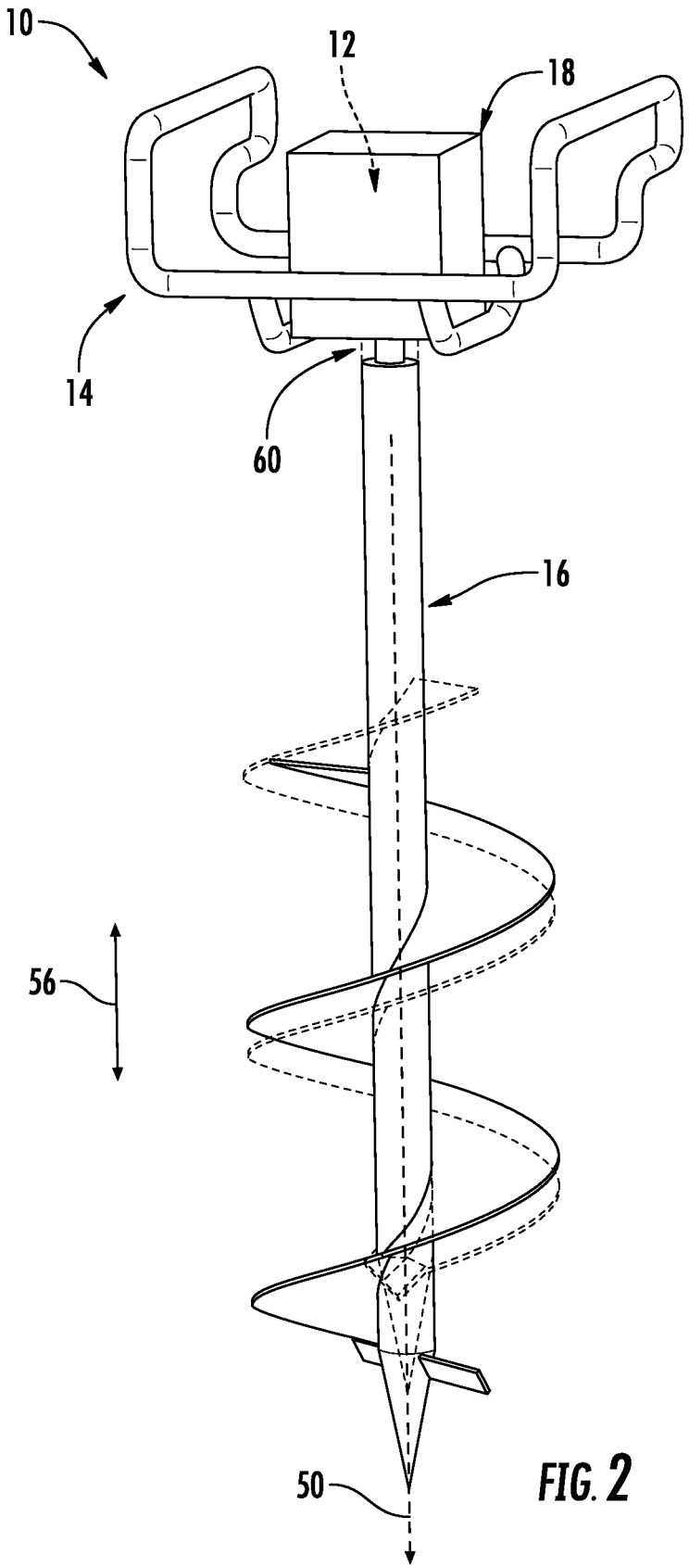
FIG. 2 provides a perspective view of an auger in accordance with other embodiments of the present disclosure.

For example, in some embodiments, the auger 10 may be operable in a plurality of different modes, such as in a normal mode and a breaker mode. In some embodiments in the breaker mode, the motor 20 and thus the drill bit 16 may be operable at an increased torque level, such as in some embodiments in an impact-type manner, relative to the normal mode. Additionally or alternatively, in some embodiments in the breaker mode, the drill bit 16 may be translatable along the longitudinal axis 50, such as in a reciprocating motion 56 as illustrated in FIG. 2.

In some embodiments, the various modes may be user selectable, such as via the user interface 30 and/or control apparatus 32. Additionally or alternatively, in some embodiments, suitable sensors in communication with the motor 20 and control apparatus 32 may detect when such breaker mode is necessary, such as for example, due to a sudden decrease in drill bit rotational velocity, etc., and may cause the motor 20 to automatically switch to the breaker mode. In some embodiments, the powerhead 12 and gearbox 22 may include suitable components, such as a selectively locking rotating hammer and anvil, to cause an impact-style force generation as required. In some embodiments, auger 10 may include suitable components, such as an intermediate shaft 60 along which the drill bit is translatable in a reciprocating motion and other suitable components to facilitate such reciprocating motion.

Figure 3:
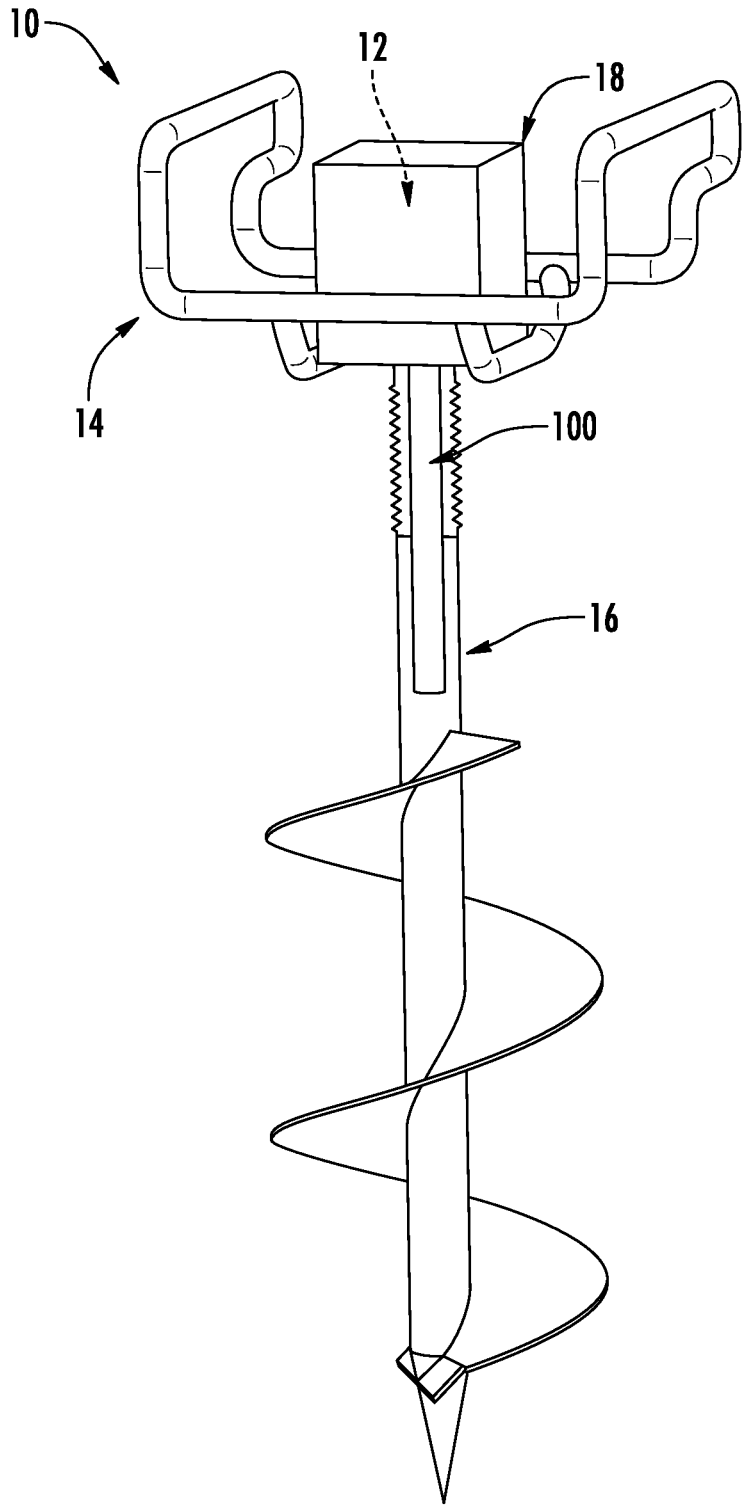
FIG. 3 provides a perspective view of an auger in accordance with other embodiments of the present disclosure.

Referring now to FIG. 3, in some embodiments, an auger 10 may further include an extension shaft 100. Further, in exemplary embodiments, the extension shaft 100 may be telescopic relative to the drill bit 16. For example, the extension shaft 100 may be disposed between the powerhead 12 and the drill bit 16, and may extend along the longitudinal axis 50. The drill bit 16 may be selectively movable and fixable at various positions along the extension shaft 100, and the extension shaft 100 may be insertable with in the drill bit 16. Accordingly, a user may slide the drill bit 16 along the longitudinal axis 50 relative to the drill bit 16 to a plurality of different positions, depending on the depth of digging needed. The drill bit 16 may be selectively fixable at each position relative to the extension shaft 100.

Figure 4:
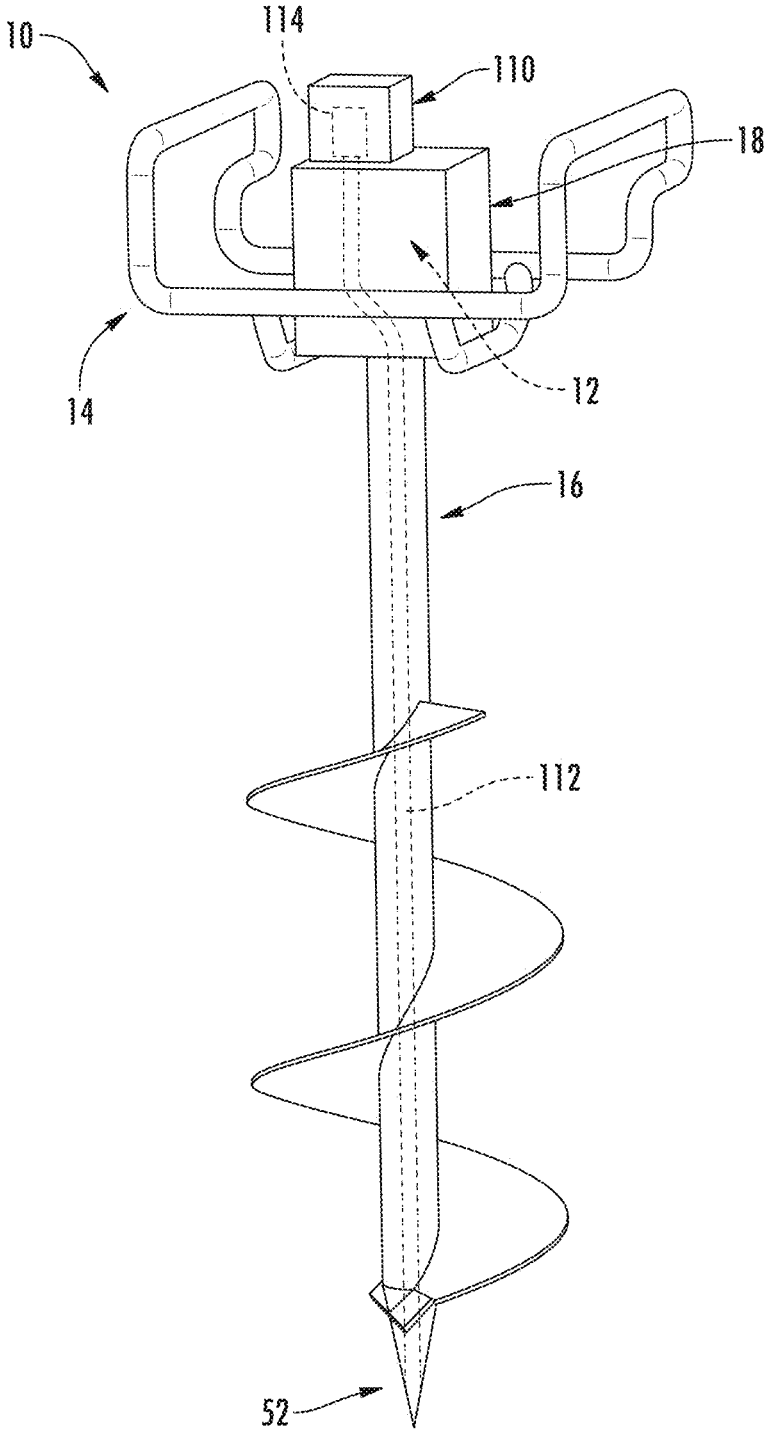
FIG. 4 provides a perspective view of an auger in accordance with other embodiments of the present disclosure.

Referring now to FIG. 4, in some embodiments, auger 10 may further include a fluid reservoir 110 and fluid line 112.

Fluid reservoir 110 may hold water or another suitable fluid which can be provided to the substrate in which a hole is being dug to moisten the substrate and facilitate easier auger 10 operation. Fluid reservoir 110 may, for example, be connected to powerhead 12 and may be within or exterior to housing 18. Fluid line 112 may be connected to fluid reservoir 110, and may extend through drill bit 16. Fluid may be exhausted from the fluid line 112 and drill bit 16 at or proximate to distal end 52. A pump 114 may be provided in fluid reservoir 110 to selectively force fluid from the fluid reservoir 110 into the fluid line 112. Pump 114 may be in communication with user interface 30 and/or control apparatus 32 such that a user can control the flow of fluid through the auger 10.

Figure 5:
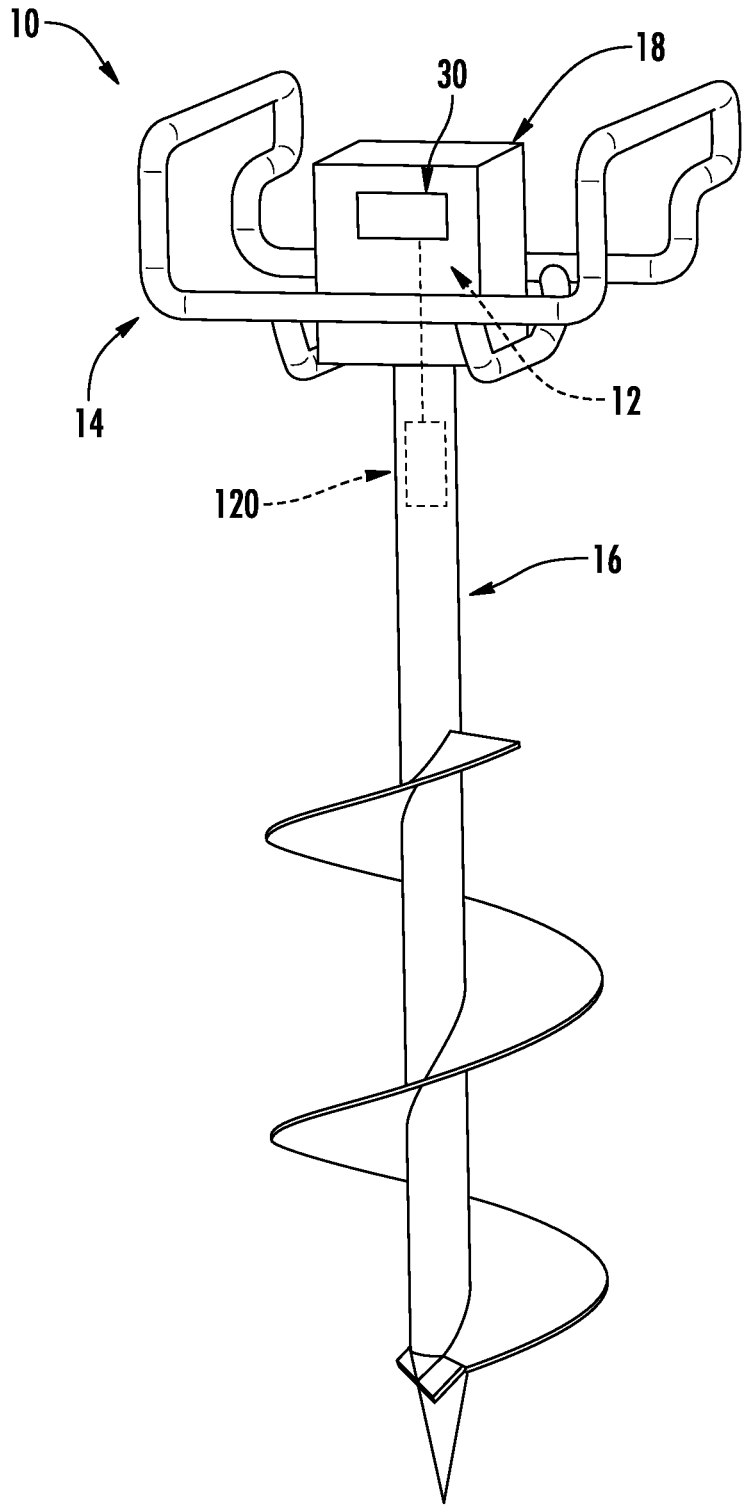
FIG. 5 provides a perspective view of an auger in accordance with other embodiments of the present disclosure.

Referring now to FIG. 5, in some embodiments, auger 10 may further include a gyroscope 120. Gyroscope 120 may be in communication with user interface 30, such as a display thereof, and may provide information to the display regarding the orientation of the auger 10. This may assist the user in maintaining the auger 10 in the proper orientation during user.

Figure 6:
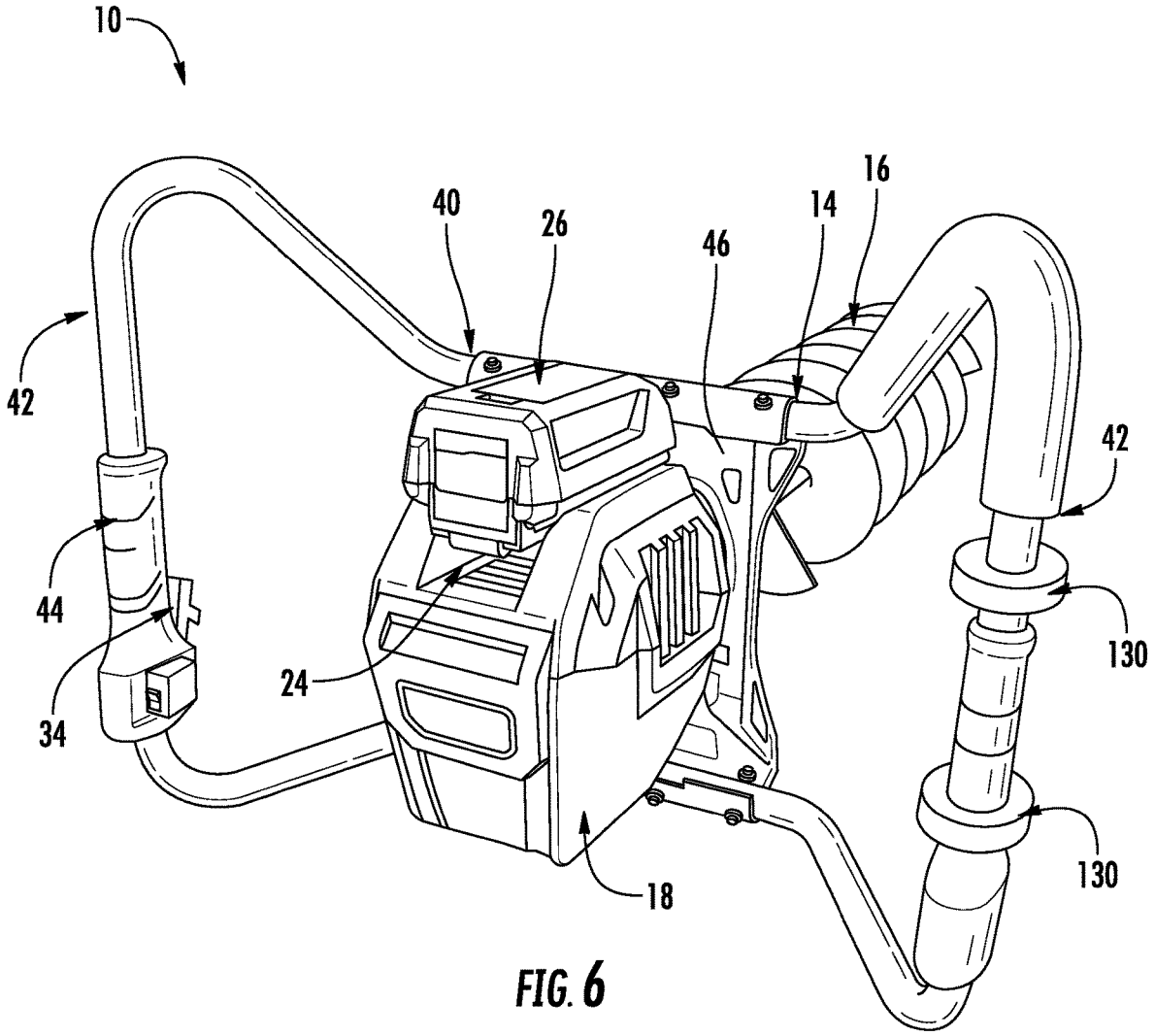
FIG. 6 is a top perspective view of an auger in accordance with embodiments of the present disclosure.

Referring now to FIG. 6, in some embodiments, auger 10 may further include one or more rollers 130. Rollers 130 may be rotatably mounted on the handle frame 14, such as on one or more side frames 42 thereof. Rollers 130 may facilitate improved, easier transportation of the auger 10.

Figure 7:
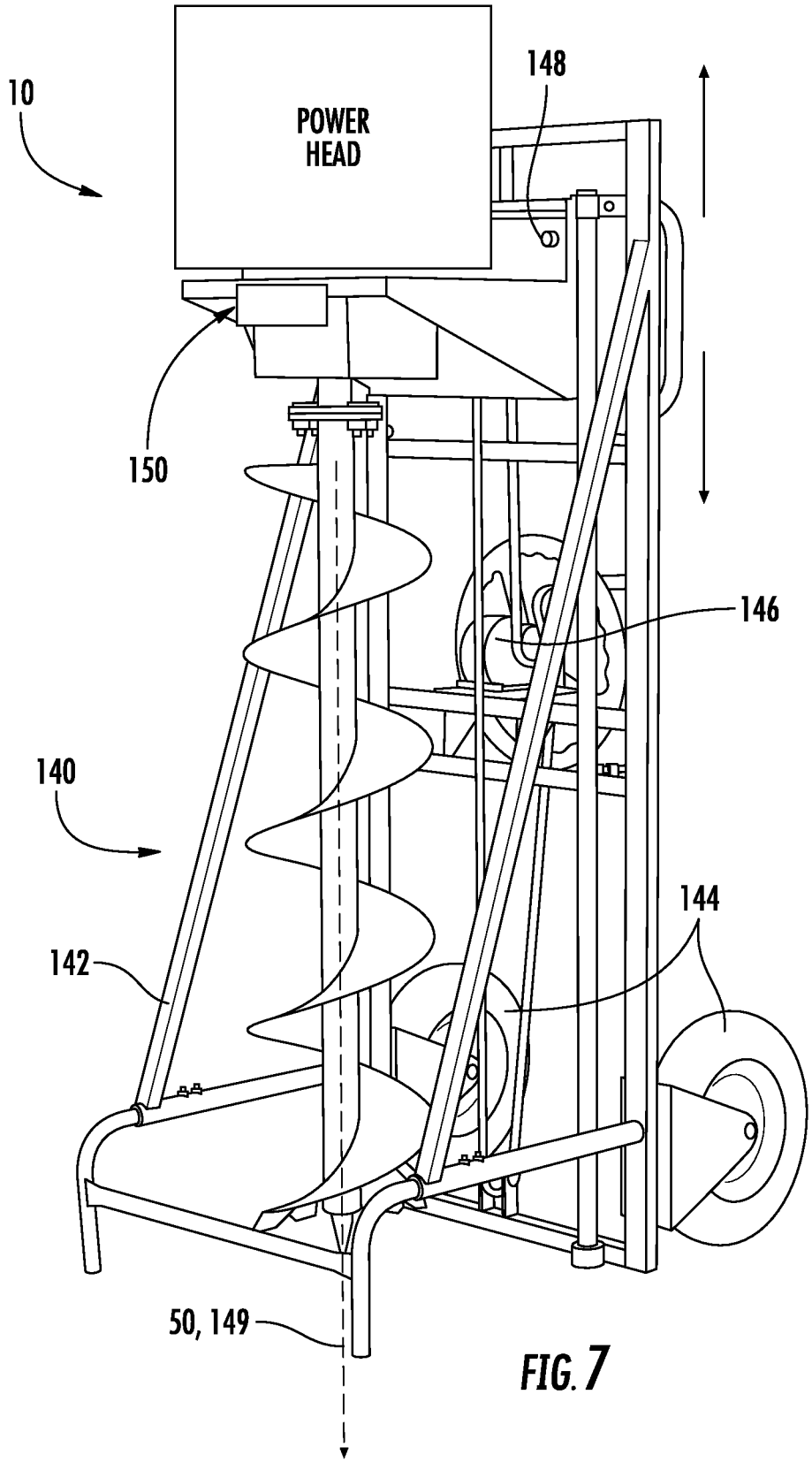
FIG. 7 is a perspective view of an auger assembly in accordance with embodiments of the present disclosure.

Referring now to FIG. 7, in some embodiments, an auger assembly may include an auger 10, and may further include a removable fixture 140 to which auger 10 may be movably mounted. Fixture 140 may include a frame 142, and may further include wheels 144, a motor 146, and/or a movable mount 148. Mount 148 may be movable relative to frame 142 along a longitudinal axis 149 which, when auger 10 is mounted to the fixture 140, may be coaxial with longitudinal axis 50. Motor 146 may be connected to the mount 148, and may selectively drive the movement of the mount 148 relative to the frame 142. When mounted, the auger 10 may be mounted to the mount 148 such that it is movable relative to the frame 142.

In these embodiments, a user can advantageously mount the auger 10 to the fixture 140 and position the auger 10 and fixture 140 at a location at which a substrate is to be dug. The auger 10 may be operated to rotate the drill bit 16, and the fixture 140 may be operated to move the auger 10 along the longitudinal axes 149, 50, such that the user is not required to manually move the auger 10 in such manner.

In some embodiments, the auger 10 and/or fixture 140 may include a depth gauge 150. For example, depth gauge 150 may be connected to motor 146, and the user may be able to select a desired depth to which the auger 10 digs into a substrate. The depth gauge 150 may then cause the motor 146 to move the mount 148, causing movement of the auger 10, until such depth is reached.

As discussed, depth gauge 150 may be utilized on auger 10 and/or fixture 140. Depth gauge 150 may include a suitable depth sensor to facilitate monitoring of an actual depth of the auger 10 relative to a desired depth. In some embodiments, on or more features of U.S. Pat. No. 10,807,219, which is incorporated by reference herein in its entirety, may be included in depth gauge 150, auger 10, and/or fixture 140 to facilitate such depth sensing.

Further aspects of the invention are provided by one or more of the following embodiments:

An auger including a powerhead, a handle frame, and a drill bit, the drill bit extending along a rotatable about a longitudinal axis.

An auger of any one or more of the embodiments described herein, wherein the drill bit is selectively operable in a normal mode and a breaker mode.

An auger of any one or more of the embodiments described herein, wherein torque applied to the drill bit by a motor of the powerhead is greater in the breaker mode than in the normal mode.

An auger of any one or more of the embodiments described herein, wherein the drill bit is translatable along the longitudinal axis in a reciprocating motion in the breaker mode.

An auger of any one or more of the embodiments described herein, wherein the normal mode and breaker mode are user selectable.

An auger of any one or more of the embodiments described herein, further comprising a sensor which can detect when the breaker mode is necessary.

An auger of any one or more of the embodiments described herein, wherein the drill bit is automatically operable in the breaker mode when the sensor detects that the breaker mode is necessary.

An auger of any one or more of the embodiments described herein, further comprising an intermediate shaft along which the drill bit is translatable in a reciprocating motion.

An auger of any one or more of the embodiments described herein, further comprising a user interface.

An auger of any one or more of the embodiments described herein, further including an extension shaft disposed between the powerhead and the drill bit, wherein the drill bit is movable along the longitudinal axis relative to the extension shaft.

An auger of any one or more of the embodiments described herein, wherein the extension shaft is insertable within the drill bit.

An auger of any one or more of the embodiments described herein, wherein the extension shaft is insertable within the drill bit.

An auger of any one or more of the embodiments described herein, wherein the drill bit is selectively fixable at a plurality of positions along the extension shaft.

An auger of any one or more of the embodiments described herein, further including a fluid reservoir and a fluid line.

An auger of any one or more of the embodiments described herein, wherein the fluid line extends through the drill bit.

An auger of any one or more of the embodiments described herein, further including a pump disposed in the fluid reservoir and in communication with the fluid line.

An auger of any one or more of the embodiments described herein, wherein the flow of fluid through the fluid line is user controllable.

An auger of any one or more of the embodiments described herein, further including a gyroscope.

An auger of any one or more of the embodiments described herein, further including a roller.

An auger of any one or more of the embodiments described herein, further including a depth gauge.

An auger assembly including an auger in accordance with any or more of the embodiments described herein and further including a removable fixture.

An auger assembly of any one or more of the embodiments described herein, wherein the auger is movably and removably mounted to the removable fixture.

An auger assembly of any one or more of the embodiments described herein, wherein the removable fixture further comprises a frame, a motor, and a movable mount.

An auger assembly of any one or more of the embodiments described herein, wherein the removable fixture further comprises a frame, a motor, and a movable mount.

An auger assembly of any one or more of the embodiments described herein, further including a depth gauge.

An auger in accordance with one or more embodiments as shown and described herein.

An auger assembly in accordance with one or more embodiments as shown and described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An auger, comprising:

a powerhead;

a handle frame;

a drill bit, the drill bit extending along and rotatable about a longitudinal axis, wherein the drill bit is selectively operable in a normal mode and a breaker mode;

an extension shaft disposed between the powerhead and the drill bit, wherein the drill bit is movable along the longitudinal axis relative to the extension shaft and selectively fixable at a plurality of positions along the extension shaft; and a sensor which can detect when the breaker mode is necessary, and wherein the drill bit is automatically operable in the breaker mode when the sensor detects that the breaker mode is necessary;

wherein the sensor detects when the breaker mode is necessary based on a decrease in drill bit rotational velocity; and wherein the drill bit is translatable along the longitudinal axis in a reciprocating motion relative to the powerhead and the handle frame in the breaker mode.

2. The auger of claim 1, wherein torque applied to the drill bit by a motor of the powerhead is greater in the breaker mode than in the normal mode.

3. The auger of claim 1, wherein the normal mode and breaker mode are user selectable.

4. The auger of claim 1, further comprising an intermediate shaft along which the drill bit is translatable in a reciprocating motion.

5. The auger of claim 1, further comprising a user interface.

6. The auger of claim 1, further comprising a gyroscope.

7. The auger of claim 1, further comprising a roller.

8. The auger of claim 1, further comprising a depth gauge.

9. The auger of claim 1, wherein the extension shaft is insertable within the drill bit.

10. The auger of claim 1, further comprising at least one battery in communication with the powerhead for selectively operating the powerhead.

11. The auger of claim 1, wherein the handle frame comprises at least one handle grip.

12. The auger of claim 1, wherein the handle frame comprises a bottom frame and two side frames, wherein a handle grip is mounted to each of the two side frames, wherein the two side frames extend from the bottom frame such that the handle grips are positioned at a higher vertical position than the bottom frame, wherein the bottom frame includes a mounting plate, and wherein the powerhead is removably couplable to the mounting plate.

13. The auger of claim 1, wherein the powerhead generates impact-style force in the breaker mode.

14. The auger of claim 1, wherein the handle frame comprises:

a bottom frame;

a first side frame coupled to the bottom frame; and a second side frame coupled to the bottom frame opposite the first side frame;

wherein the first side frame and the second side frame extend upwardly from the bottom frame to define a U-shape.

15. The auger of claim 14, further comprising a mounting plate coupled to the bottom frame, wherein the powerhead is removably couplable to the bottom frame through the mounting plate.

16. The auger of claim 1, wherein the drill bit is selectively fixable at a desired position along the longitudinal axis of the extension shaft based on a desired drilling depth.

17. A hand-held auger, comprising:

a powerhead;

at least one battery in communication with the powerhead for selectively operating the powerhead;

a handle frame, wherein the handle frame comprises a bottom frame and two side frames, and wherein a handle grip is mounted to each of the two side frames;

a drill bit, the drill bit extending along and rotatable about a longitudinal axis, wherein the drill bit is selectively operable in a normal mode and a breaker mode;

an extension shaft disposed between the powerhead and the drill bit, wherein the drill bit is movable along the longitudinal axis relative to the extension shaft and selectively fixable at a plurality of positions along the extension shaft; and a sensor which can detect when the breaker mode is necessary, and wherein the drill bit is automatically operable in the breaker mode when the sensor detects that the breaker mode is necessary;

wherein the sensor detects when the breaker mode is necessary based on a decrease in drill bit rotational velocity; and wherein the drill bit is translatable along the longitudinal axis in a reciprocating motion relative to the powerhead and the handle frame in the breaker mode.

18. The hand-held auger of claim 17, wherein torque applied to the drill bit by a motor of the powerhead is greater in the breaker mode than in the normal mode.

* * * * *